US007051416B2

(12) United States Patent
Yabu

(10) Patent No.: US 7,051,416 B2
(45) Date of Patent: May 30, 2006

(54) GOLF CLUB HEAD AND METHOD OF MAKING THE SAME

(75) Inventor: Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/025,906

(22) Filed: Jan. 3, 2005

(65) Prior Publication Data

US 2005/0108865 A1 May 26, 2005

Related U.S. Application Data

(62) Division of application No. 10/293,501, filed on Nov. 14, 2002, now Pat. No. 6,852,038.

(30) Foreign Application Priority Data

Nov. 28, 2001 (JP) ..... 2001-363072

(51) Int. Cl.
*B23P 25/00* (2006.01)
*A63B 53/04* (2006.01)

(52) U.S. Cl. ..... 29/527.6; 29/418; 29/423; 29/527.5

(58) Field of Classification Search ..... 29/527.5, 29/527.6, 418, 422, 423; 164/45, 516, 34, 164/35; 473/224, 332, 345, 346, 329
See application file for complete search history.

(56) References Cited

U.S. PATENT DOCUMENTS

| | | | | |
|---|---|---|---|---|
| 4,214,754 A | | 7/1980 | Zebelean | |
| 4,438,931 A | | 3/1984 | Motomiya | |
| 4,472,092 A | * | 9/1984 | Schmidt | 164/35 |
| 5,141,230 A | | 8/1992 | Antonious | |
| 5,180,166 A | | 1/1993 | Schmidt et al. | |
| 5,292,129 A | | 3/1994 | Long et al. | |
| 5,467,983 A | | 11/1995 | Chen | |
| 5,651,932 A | * | 7/1997 | Butler | 264/225 |
| 5,669,828 A | * | 9/1997 | Schmidt | 473/345 |
| 5,718,641 A | | 2/1998 | Lin | |
| 5,908,356 A | | 6/1999 | Nagamoto | |
| 5,941,782 A | | 8/1999 | Cook | |
| 6,299,547 B1 | | 10/2001 | Kosmatka | |
| 6,309,311 B1 | | 10/2001 | Lu | |
| 6,406,654 B1 | * | 6/2002 | Perez et al. | 264/225 |
| 6,595,871 B1 | | 7/2003 | Sano | |
| 6,645,087 B1 | | 11/2003 | Yabu | |
| 2002/0187849 A1 | * | 12/2002 | Kusumoto et al. | 473/305 |

FOREIGN PATENT DOCUMENTS

| | | | |
|---|---|---|---|
| JP | 10-33724 A | | 2/1998 |
| JP | 11-276644 | * | 10/1999 |
| JP | 2001-187174 A | | 7/2001 |

* cited by examiner

*Primary Examiner*—Eric Compton
(74) *Attorney, Agent, or Firm*—Birch, Stewart, Kolasch & Birch, LLP

(57) ABSTRACT

A golf club head comprises a hollow body having a cavity, a plurality of rib-like walls provided on the inner surface of the hollow body so as to extend backward from a position near the face portion, and a sound bar disposed behind the face portion so as to extend along the back face of the face portion.

A method of making a golf club head comprises making a wax model of the hollow main body having an opening, wherein in order to prevent deformation of the wax model during making a casting mold, the wax model is provided with a brace which extends across the opening and protruding walls which are disposed on the inner surface of the wax model and extend backwards from the opening.

7 Claims, 13 Drawing Sheets

GOLF CLUB HEAD AND METHOD OF MAKING THE SAME

This application is a Divisional of application Ser. No. 10/293,501, filed on Nov. 14, 2002, now U.S. Pat. No. 6,852,038 and for which priority is claimed under 35 U.S.C. § 120; and this application claims priority of Application No. 2001-363072 filed in Japan on Nov. 28, 2001 under 35 U.S.C. § 119; the entire contents of all are hereby incorporated by reference.

BACKGROUND OF THE INVENTION

The present invention relates to a golf club head and a method of making the same, more particularly to an inside structure which can improve the hitting sound of golf clubs and the dimensional accuracy of the club head.

In recent years, wood-type golf clubs, whose head is made of metal materials such as stainless steel and titanium alloy, are widely used as being superior to persimmon heads with respect to the weight distribution, moment of inertia, gravity point and the like with respect to the hitting sound, however, many golfers have a preference for persimmon heads. Thus, there are strong demands for such metal heads to improve the hitting sound.

On the other hand, the wood-type metal heads are increased in the volume and it reaches up to 400 cc in these days. In a large head having whose volume is more than 250 cc, therefore, the metal head is made as being hollow and the thickness is decreased to prevent the weight from increasing excessively.

Therefore, when a main body part (c) shown in FIG. 19 is made by lost-wax precision casting which is a mainstream method of making such a large head, it is difficult to maintain the shape of a wax model properly during making a mold for casting.

In particular, the crown portion and sole portion of the wax model are liable to deform due to the opening (O) and the dimensional accuracy of the casting is liable to become worse and as a result, the percent defective increases.

SUMMARY OF THE INVENTION

It is therefore a principal object of the present invention is to provide a golf club head in which the hitting sound is improved.

A further object of the present invention is to provide a method of making a golf club head which can improve not only the hitting sound but also the dimensional accuracy of the club head.

According to the present invention, a golf club head comprises a hollow body having a cavity and comprising a face portion having a front face defining a club face for hitting a ball and a back face facing the cavity, a plurality of rib-like walls provided on the inner surface of the hollow body facing the cavity so as to extend backward from a position adjacent to the back face of the face portion, and at least one sound bar disposed behind the face portion so as to extend along the back face at a small distance from the back face.

According to the present invention, a method of making a golf club head comprising a hollow main body provided on the front with an opening and a face plate disposed on the front of the main body, comprises making a hollow wax model of the hollow main body, wherein the wax model has an opening corresponding to the above-mentioned opening and the wax model comprises at least one brace and protruding walls, the above-mentioned brace extends across the opening to prevent deformation of the wax model, and the protruding walls are disposed on the inner surface of the wax model and extend backwards from the opening, making a casting mold using the wax model, and casting a metal material into the head main body using the casting mold.

BRIEF DESCRIPTION OF THE DRAWINGS

FIGS. 18(*b*) and 18(*c*) show processes of casting a metal material into the head main body.

DESCRIPTION OF THE PREFERRED EMBODIMENTS

Figure 1:
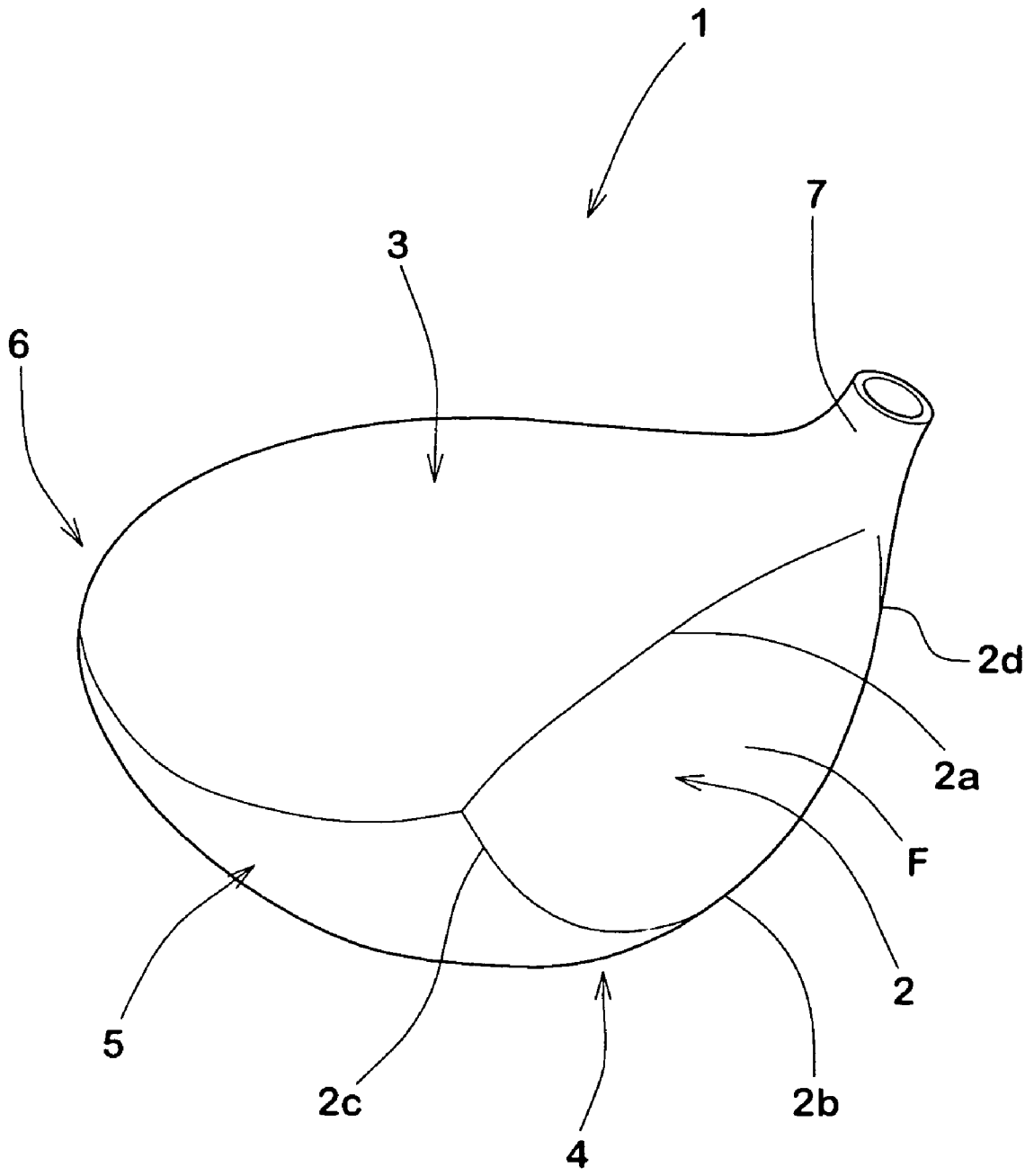
FIG. 1 is a perspective view of a wood-type golf club head according to the present invention.

Embodiments of the present invention will now be described in detail in conjunction with the drawings.

In the drawings, golf club head 1 according to the present invention is a wood-type club head having a closed cavity (i) and a relatively large head volume of 200 to 500 cc.

The club head 1 comprises a face portion 2 defining a club face F for hitting a ball, a crown portion 3 defining a top face of the club head, a sole portion 4 defining a sole of the club head, a side portion 5 between the crown portion 3 and sole portion 4 which extends between a toe-side edge 2*c* and a heel-side edge 2*d* of the face portion 2 through the back face 6 of the club head, and a hosel 7 provided with an opening of a shaft inserting hole.

The face portion 2 comprising a central part 2A having a substantially constant thickness T1 of from 2.5 to 3.5 mm and a thin periphery part 2B which is formed around the central part 2A and has a thickness T2 being 0.3 to 0.7 mm less than the thickness T1 and a width GW of from 3 to 5 mm, whereby the decay of the vibration of the face portion 2 after hitting a ball can be controlled to enhance the reverberant sound. If the thickness T1 of the central region 2A is less than 2.5 mm, the durability of the face portion 2 tends to decrease. If the thickness T1 is more than 3.5 mm, the rebound performance against a ball tends to decrease. Preferably, the thickness T1 is set in a range of from 2.6 to 3.0 mm, and the difference between the thickness T1 and thickness T2 is set in a range of from 0.3 to 0.5 mm.

Figure 5:
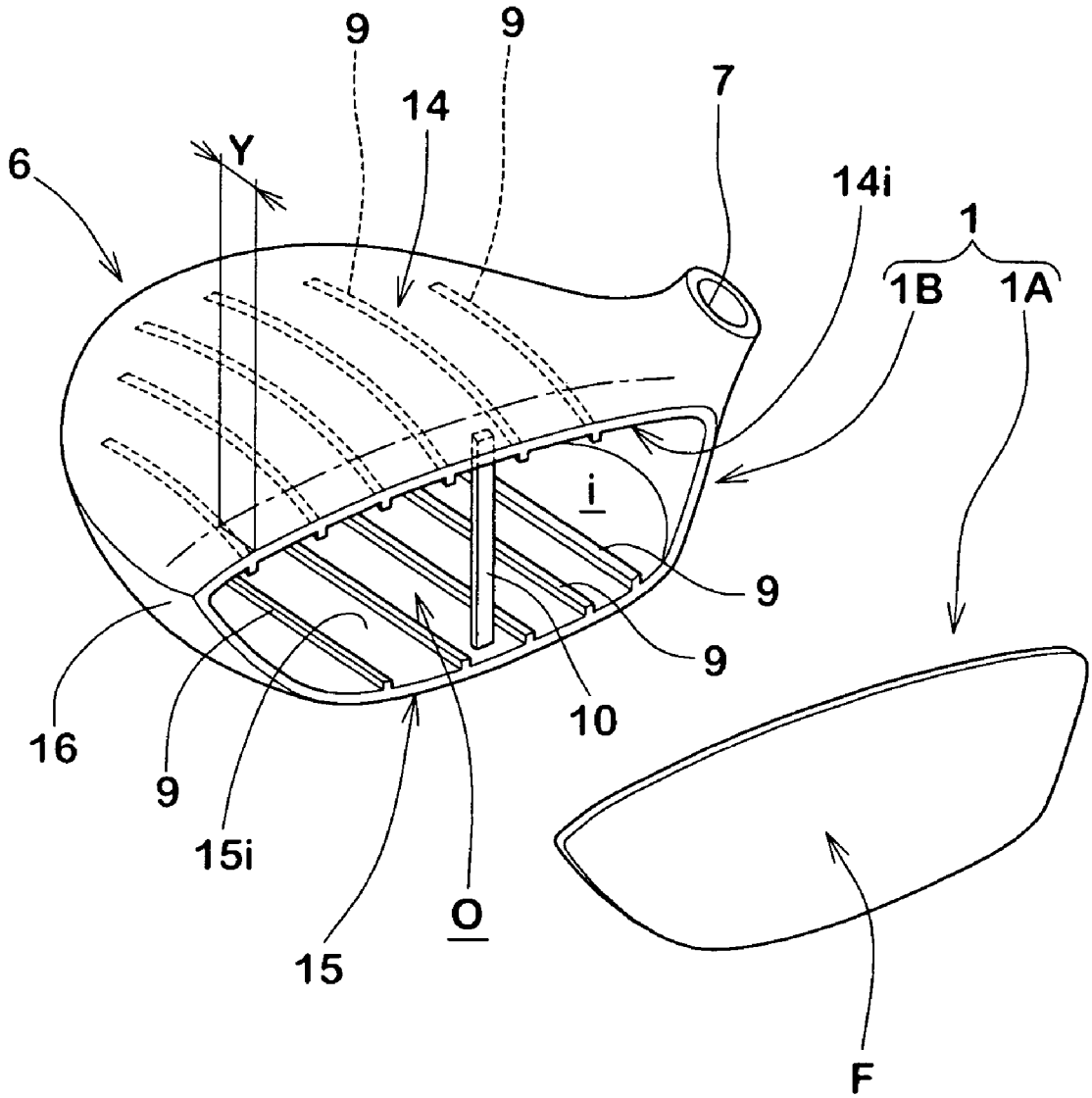
FIG. 5 is an exploded perspective view thereof showing a head main body, a face plate and a sound bar.

The club head 1 in this example has a two-piece structure comprising a main body 1B and a face plate 1A as shown in FIG. 5.

The face plate 1A can be made of various metal materials such as aluminum alloy, pure titanium, titanium alloy and stainless steel. Depending on the material, the face plate 1A is formed by a suitable method such as forging, press working and casting. In this example, a titanium alloy is used and forging is employed. The face plate 1A in this example is composed of only a platy main portion which is substantially flat or slightly curved and of which front surface defines at least a part, in this example the entirety, of the club face F. As a modification of the face plate 1A, it is possible to make additionally a backward extension at the edge of the above-mentioned platy main portion usually such extension is formed partially of the edge so that the face plate 1A becomes L-shaped or u-shaped in a cross section. But it may be also possible to make such extension along the entirety of the edge like a shallow tray.

The head main body 1B comprises a shell crown portion 14, a shell sole portion 15, a shell side portion 16 therebetween and the above-mentioned hosel 7. The shell crown portion 14, shell sole portion 15 and shell side portion 16 each form the entirety or a part of the crown portion 3, sole portion 4 and side portion, respectively. In this embodiment where the face plate is platy or no extension is additionally formed at the edge, each portion (14, 15, 16) forms the entirety of the corresponding portion (3, 4, 5). However, in case a backward extension is additionally formed as explained above, according to its position and dimension, the portion (14, 15, 16) forms a part of the corresponding portion (3, 4, 5) and the extension forms the rest.

In any case, the main body 1B is hollow and an opening (O) is formed at the front thereof.

The head main body 1B is a casting of a metal material such as aluminum alloy, titanium alloy and stainless steel. In this embodiment, the head main body 1B is made of a titanium alloy Ti-6Al -4V, using lost-wax precision casting. Each of the shell crown portion 14, shell sole portion 15 and shell side portion 16 has a thickness of from 0.8 to 1.2 mm in its large portion or almost entirety.

On the front of the main body 1B, the face plate 1A is disposed so as to close the opening (O), and in this example they are fixed by welding the edge of the face plate 1A to the edge of the opening (O).

In order to improve the hitting sound, rib-like walls 9 and at least one sound bar 10 are provided on the head main body 1B.

Each of the rib-like walls 9 is a relatively partition wall which extends backward from a position near the face portion 2 along the inner surface of the head main body 1B facing the cavity (i). In this example, the rib-like walls 9 are disposed on the inner surface 14*i* of the shell crown portion 14 and the inner surface 15*i* of the shell sole portion 15. The rib-like walls 9 extend along respective planes which are substantially parallel with each other and inclined in one direction at a small angle of less than 20 degrees with respect to the normal direction to the club face F (in this embodiment, zero degrees or substantially perpendicular to the club face F).

Each rib-like wall 9 has a thickness w of from 0.5 to 3.0 mm, preferably 1.0 to 2.0 mm and a height H of from 0.3 to 5.0 mm, preferably 0.5 to 3.0 mm. More preferably, the height H is 0.5 to 3.0 times the thickness of the shell crown portion 14.

In this example, the rib-like wall height H and width W are substantially constant along the length of the rib-like wall 9.

Figure 10:
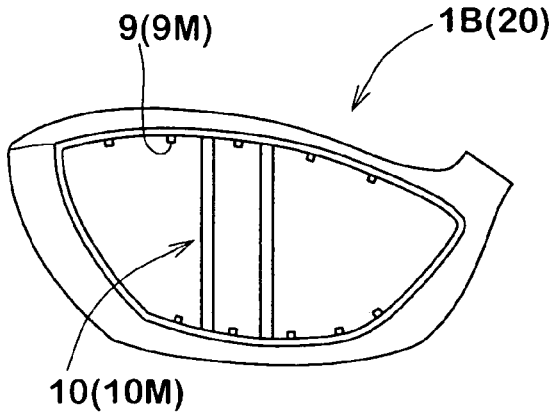
FIGS. 10 to 15 are front views for the head main body (and a wax model thereof)

For the sectional shape of the rib-like wall 9, various shapes may be used such as a rectangle as shown in FIG. 10 wherein the corners are rounded, a semicircle as shown in FIG. 11(A) which have a diameter corresponding to the thickness W, and a triangle as shown in FIG. 11(B).

In each of the crown portion and sole portion, the number of the rib-like walls 9 is preferably set in a range of from 2 to 10, more preferably 5 to 10.

The arrangement pitches P of the rib-like walls 9, which are the distances between the thickness center lines 9C of the walls 9, are set in a range of from 0.85 to 15.0 mm, more preferably 3.0 to 15.0 mm, still more preferably 3.0 to 12.0 mm.

The total volume v of all the rib-like walls 9 is preferably limited in a range of from 400 to 1200 cu.mm, more preferably 500 to 1000 cu.mm in order to effectively improve the hitting sound while preventing the club head from excessively increasing in the weight.

In this embodiment, each of the shell crown portion 14 and shell sole portion 15 is provided with a plurality of rib-like walls 9. But, it is also possible to provide a plurality of rib-like walls 9 in only one of these portions 14 and 15 or additionally in the shell side portion 16.

Figure 7:
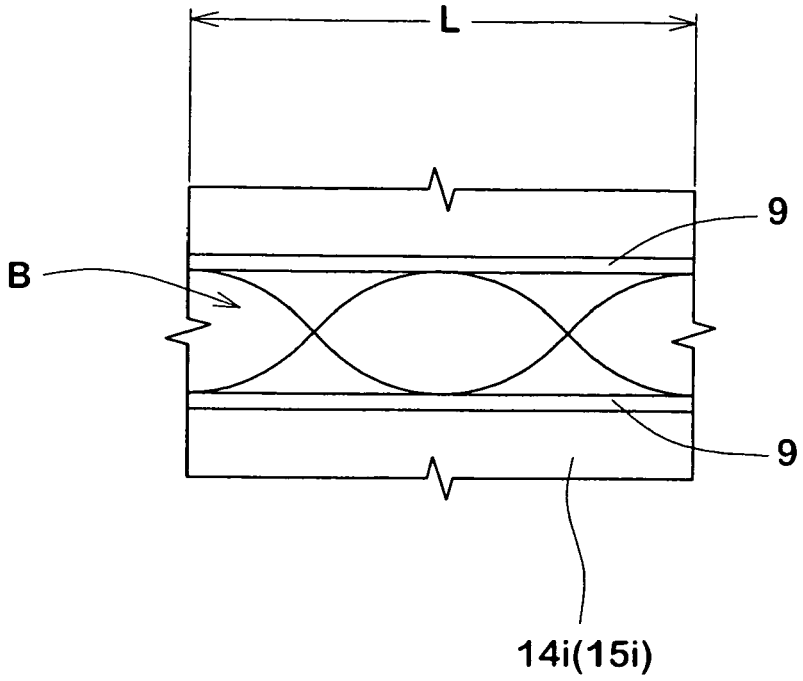
FIG. 7 is a diagram for explaining a split vibration caused by of the rib-like walls.
Figure 6:
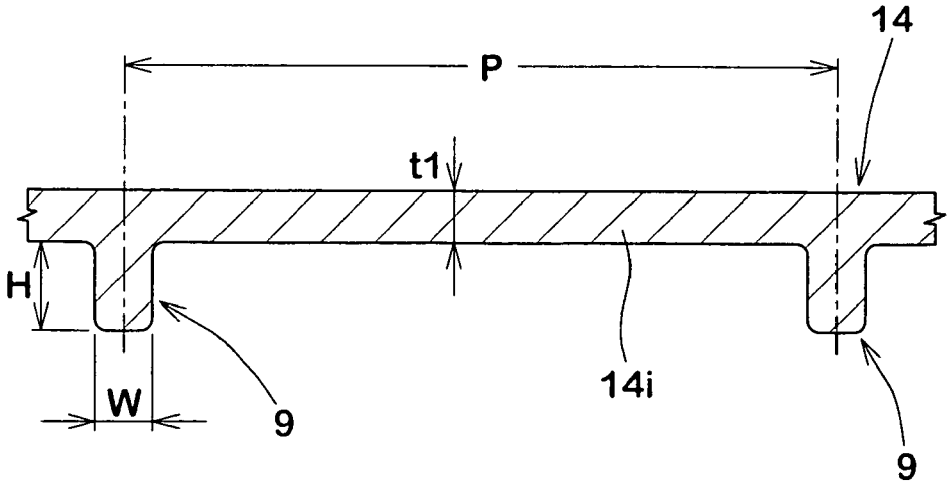
FIG. 6 is an enlarged cross sectional view taken along a line A—A of FIG. 2 showing rib-like walls.
Figure 8:
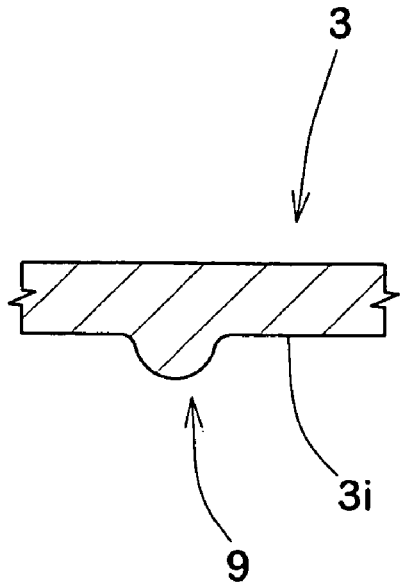
FIGS. 8 and 9 are enlarged cross sectional views each showing another example of the cross sectional shape of the rib-like wall.
Figure 9:
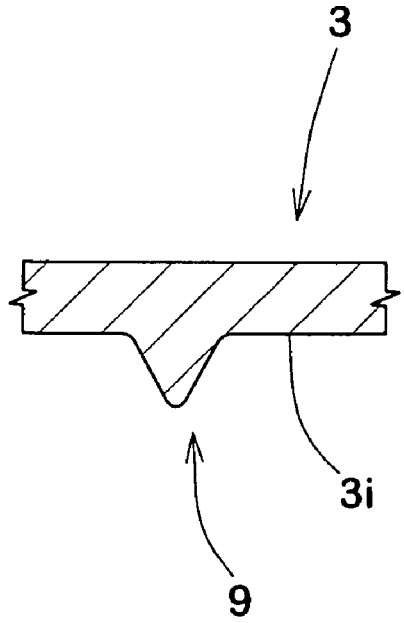

Therefore, when the club head hits a ball, the face portion is vibrated and the air behind is also vibrated. Thus, the aerial vibration or sound is emitted into the cavity from the back face of the face portion. Due to the presence of the parallel rib-like walls 9, the sound propagation is guided backwards and parted laterally by the rib-like walls 9. Thus, the vibration mode changes easily into a split vibration mode, and as show in FIG. 7, in a partition B between the adjacent rib-like walls 9, a resonance or standing wave like in a tube having a corresponding length L may be caused.

Figure 2:
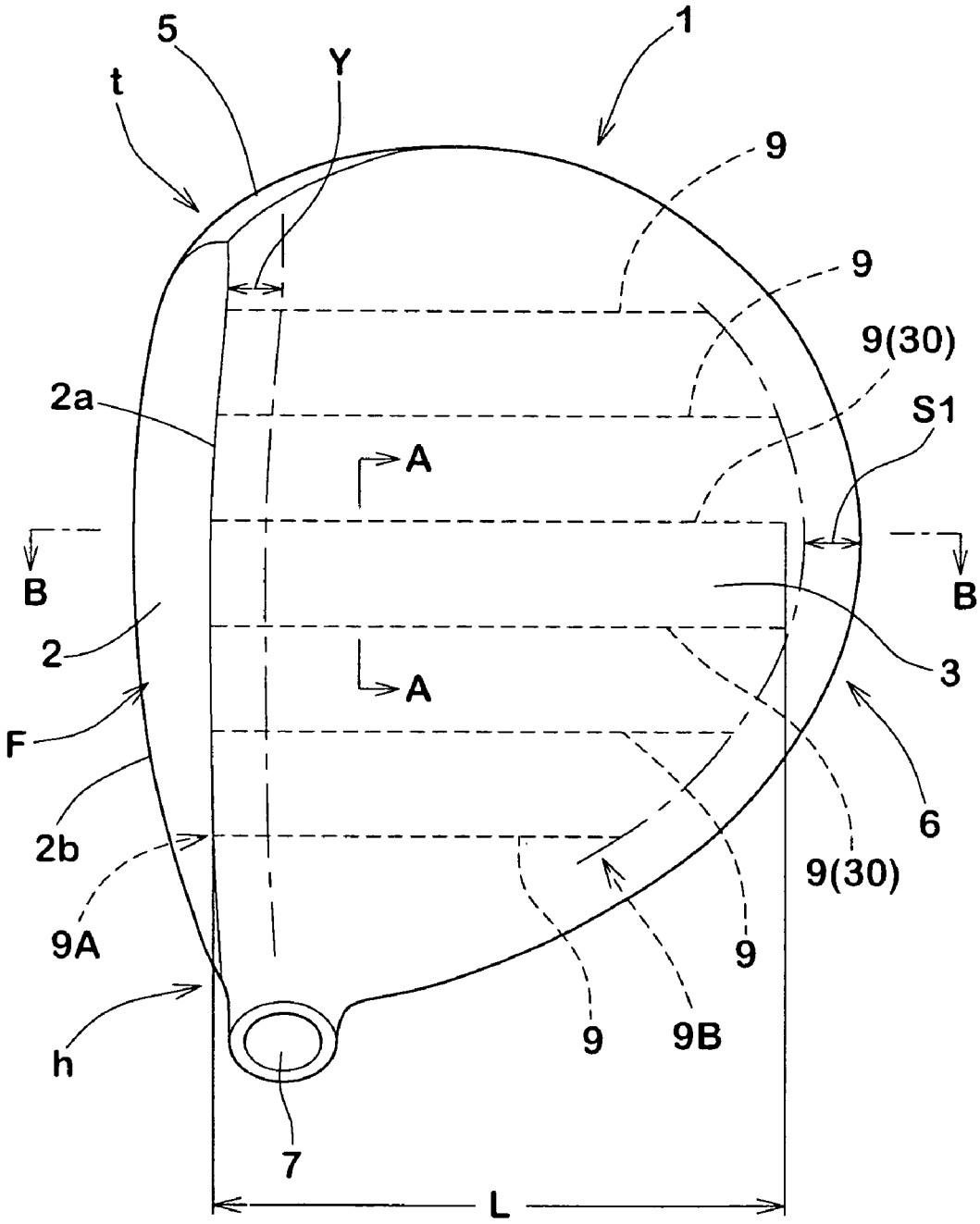
FIG. 2 is a top view thereof.

The inventor reached a conclusion on the basis of the research findings, that is, the hitting sound can be effectively improved by enhancing reverberant sound and prolong the decay in a frequency range of from 4500 to 8000 HZ, especially 5000 to 6300 HZ. Therefore, it is preferable that some of the rib-like walls 9 which are adjacent each other and have lengths L in the range of from about 42 to about 75 mm when measured in the horizontal direction of the head as shown in FIG. 2 (hereinafter "rib-like wall 30") because the geometrical length of 42 to 75 mm corresponds to the sound wave length of 4500 to 8000 Hz in the normal temperature air and as a result, sound components of the reverberant sound within such a frequency range can be enhanced to improve the hitting sound. As explained above, it is more desirable to include the rib-like walls 30 having lengths L of from about 68 to about 54 mm because such length corresponds to a frequency of 5000 to 6300 Hz. Therefore, it is preferable that at least two rib-like walls 30 having such lengths L are formed in each of the sole portion and the crown portion.

Figure 3:
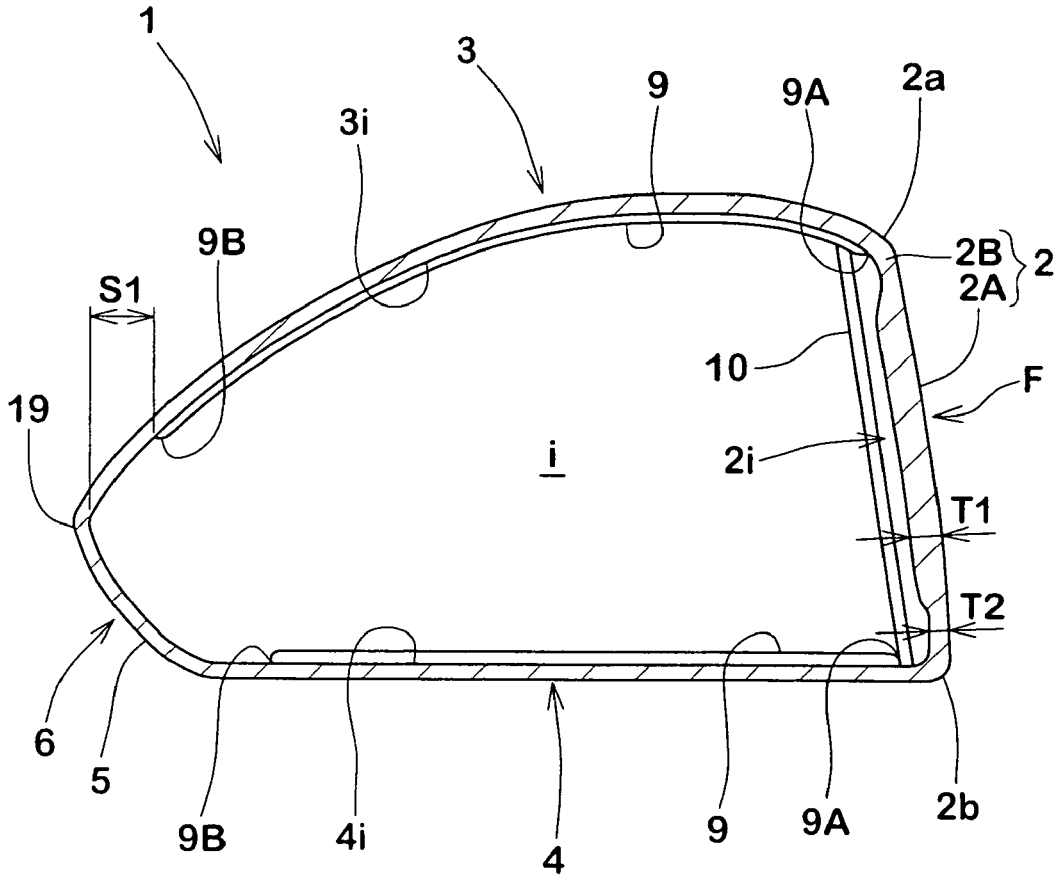
FIG. 3 is a cross sectional view thereof taken along a line B—B of FIG. 2.

From a point of view of promotion of the split vibration, it is preferable that the front ends 9A of the rib-like walls 9(30) are positioned near the back face 2*i* of the face portion 2. AS to the rear ends 9B, however, the positions are not so critical. The lengths of the rib-like walls have priority. In FIG. 3, the rear ends 9B of the rib-like walls 9 in the crown portion 3 are positioned at a horizontal distance S1 of not less than 5 mm but preferably not more than 15 mm from the upper intersection 19 of the crown portion 3 and side portion 5 to prevent injection fault or defect when making the undermentioned wax model 20 of the head main body 1B.

If the rib-like wall height H is too small, it is difficult to lead the vibration into a split vibration mode. If the rib-like wall height H and/or the rib-like wall thickness w are too large, the club head tends to unfavorably increase its weight. If the rib-like wall thickness w is too small, the rigidity id decreased and it becomes difficult to make it by casting. If the pitches P of the rib-like wall 9 are too small and the number of the rib-like walls is excessively increased, the rigidity of the crown portion and/or sole portion is greatly increased, and the sound pressure level of the hitting sound decreases, and the frequency range of the reverberant sound becomes too high, and the hitting sound tends to become unpleasant sound. If the pitches P of the rib-like walls 9 are too large, it becomes difficult to enhance the reverberant sound and the frequency range of reverberant sound becomes too low, and as a result, the hitting sound tends to become unfavorable sound. Therefore, these parameters are set as above.

Figure 11:
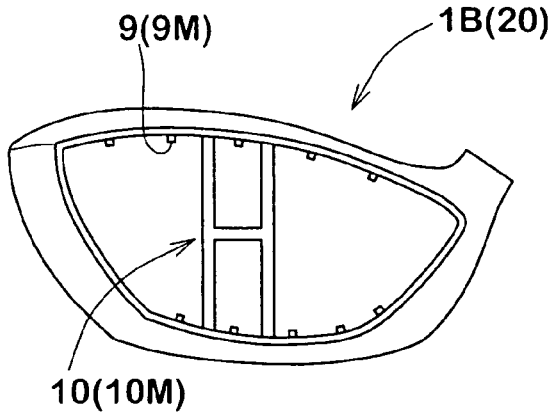
Figure 12:
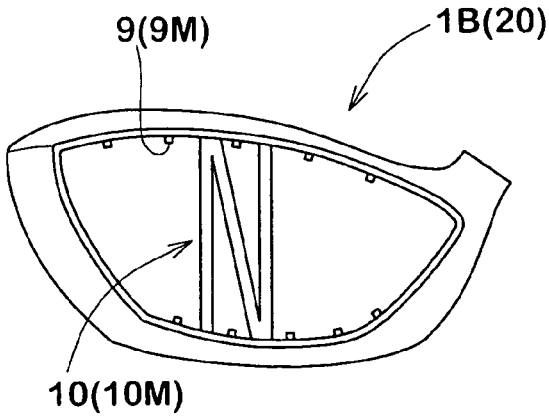
Figure 13:
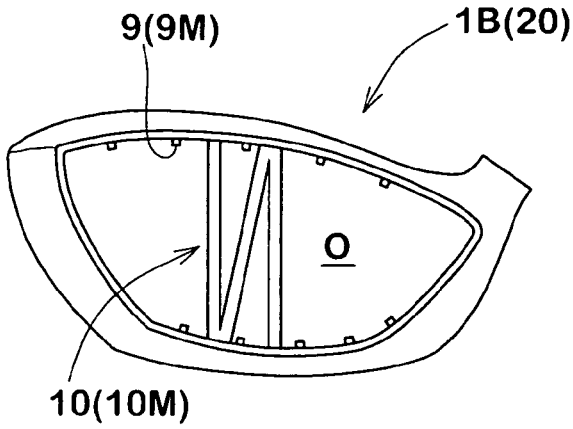
Figure 14:
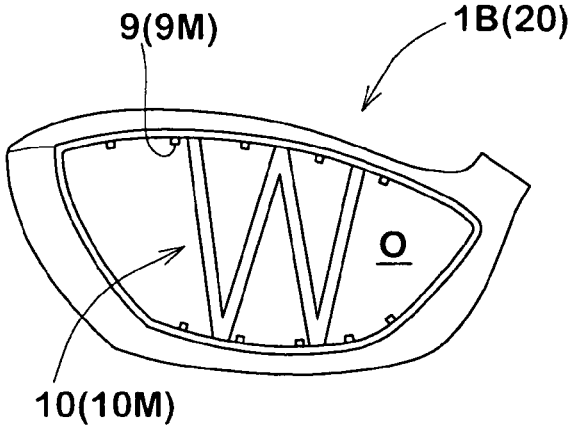
Figure 15:
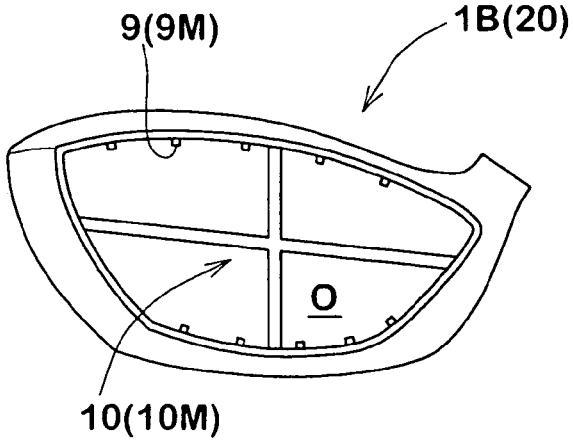

In order to further promote the split vibration, the sound bar 10 is disposed near but at a small distance from the back face 2*i* of face portion 2 namely, behind the club face F. In this embodiment, one sound bar 10 is provided in the opening (O), bridging vertically thereacross. However, a plurality of sound bars 10 may be provided in various formations as shown in FIGS. 10–15. In FIG. 10, two sound bars 10 extending vertically in parallel with each other are provided. FIG. 11 shows a modification thereof wherein a horizontal bar is added to connect mid-height points of the two vertical sound bars 10. Thus they are provided in a H-shaped formation. In FIG. 12 and FIG. 13, three sound bars are provided in a N-shaped formation, wherein two of them extend vertically in parallel with each other, but the remainder extends obliquely, inclining towards the toe (FIG. 12—normal "N") or the heel (FIG. 13—reverse "N"). In FIG. 14, four inclined sound bars 10 are provided in a W-shaped formation. In FIG. 15, two sound bars 10 are provided in a cross-shaped formation, wherein one of them extends vertically but the other extends horizontally across the face portion.

The area of the cross section of the sound bar perpendicular to its longitudinal direction is preferably set in a range of 2 to 25 sq.mm, more preferably 4 to 9 sq.mm.

The following is an example of the method of making a golf club head according to the present invention.

First, a wax model 20 of a head main body is made by injection molding using a reusable mold of course this mold is made in advance. Then, using the wax model 20, a casting mold M having a mold cavity of the same shape as the wax model is made. And using the casting mold M, the head main body is made. On the other hand, the face plate 1A is made for example by die-cutting and press working. The face plate 1A and the head main body 1B are assembled into the club head.

Figure 16:
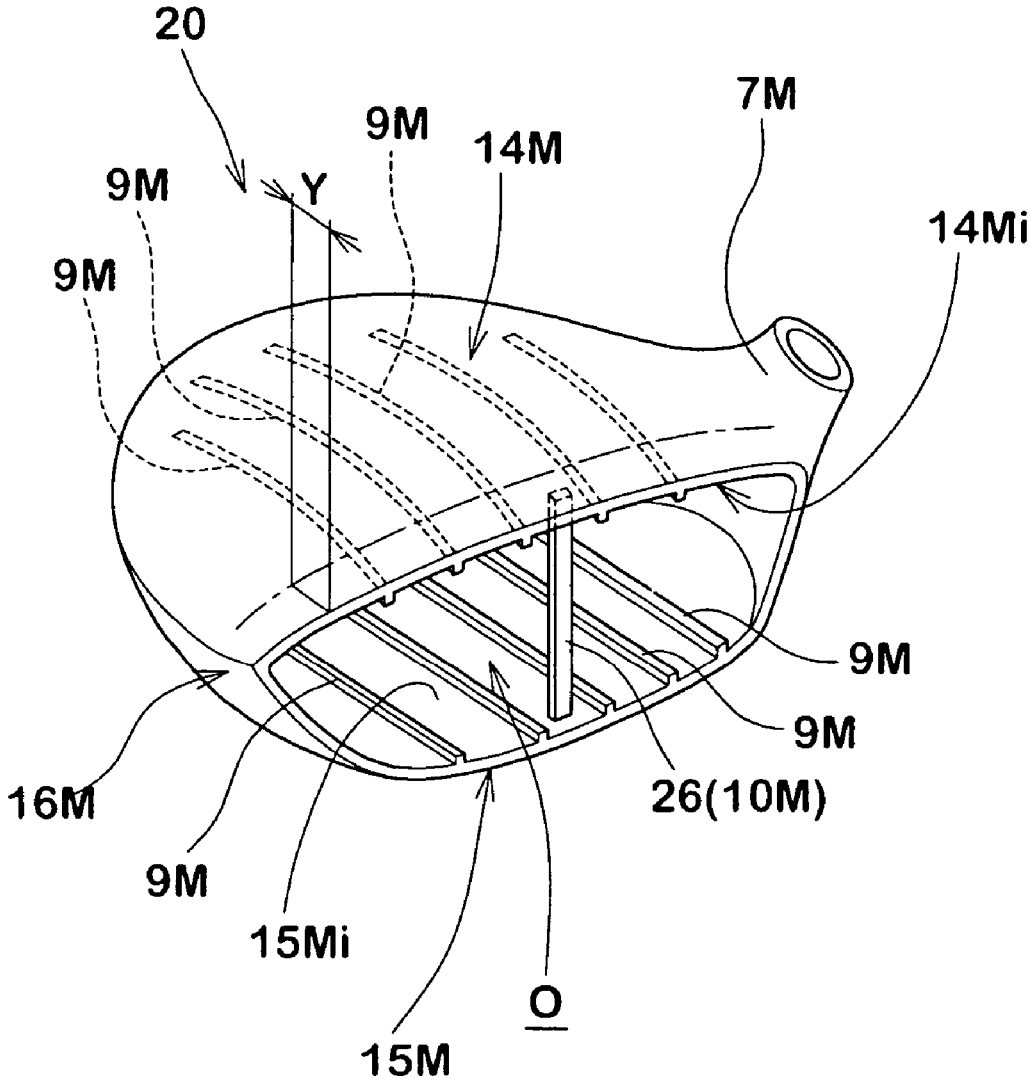
FIG. 16 is a perspective view of a wax model of the head main body shown in FIG. 5.

FIG. 16 shows a wax model 20 of the above-mentioned head main body 1B. The wax model 20 is made up of a model 14M of the shell crown portion 14, a model 15M of the shell sole portion 15, a model 16M of the shell side portion 16 between the model 14M and model 15M, and optionally a model 7M of the hosel 7. In this embodiment, as the hosel 7 is formed integrally with the other portions 14, 15 and 16, the wax model 20 includes the hosel model 7M. However, in case the hosel 7 is a separate part which is assembled, the wax model 20 does not include the hosel model 7M.

In any case, the wax model 20 has an opening corresponding to the above-mentioned opening (O).

Further, this full model 20 includes models 9M of the rib-like walls 9 disposed on the inner surface, namely, in this embodiment on the inner surface 14Mi of the shell crown portion model 14M and the inner surface 15Mi of the shell sole portion model 15M.

Figure 17:
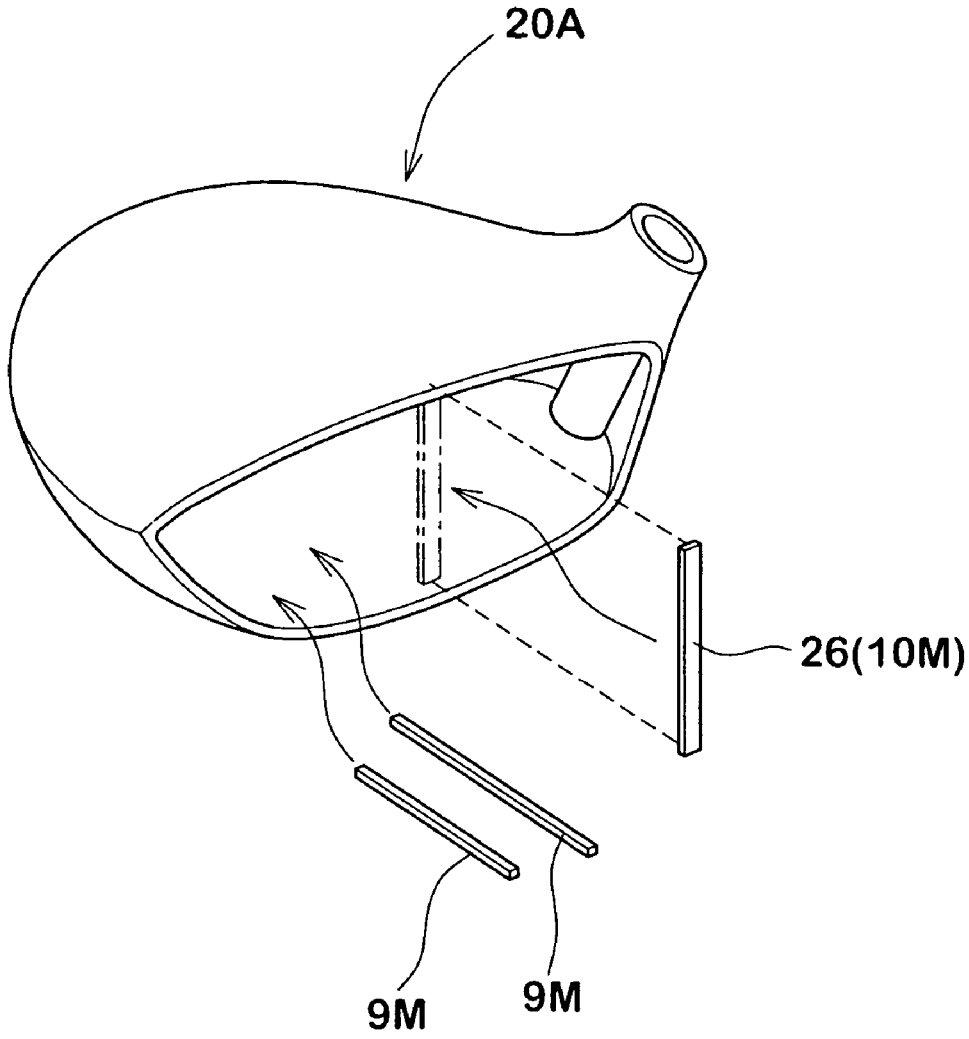
FIG. 17 is a perspective view for explaining a method of making the wax model.

The shell crown portion model 14M and the shell sole portion model 15M are fairly thin whereas the area thereof is broad. Therefore, when making the casting mold M using this wax model 20, the wax model 20 is liable to deform near the opening in particular. In order to prevent such deformation, a brace 26 which extends from the upper edge to the lower edge of the opening is provided. In this example, this brace 26 doubles as a model 10M of the sound bar 10. In case the sound bar 10 having a free end, however, as the part being cast by the brace 26 must be cut at suitable positions, the brace 26 can not be said as a model 10M of the sound bar 10 in the strict sense owing to the presence of the brace 26 and the rib-like wall models 9M, the full wax model 20 can be increased in the rigidity to effectively decrease the deformation. Thus, the dimensional accuracy can be improved. Incidentally, the wax model 20 can be made all together by injection molding, namely, including the rib-like wall models 9M and brace 26 (sound bar model 10M) as shown in FIG. 16. But, as shown in FIG. 17, it is also possible to make the rib-like wall models 9M and brace 26 (sound bar model 10M) separately from the shell main body 20A and then assemble these into one body by welding, adhesive bonding or the like. Further, the wax model 20 may be provided with a protruding part for forming a pouring gate (i2) of the casting mold M.

Figure 18A:
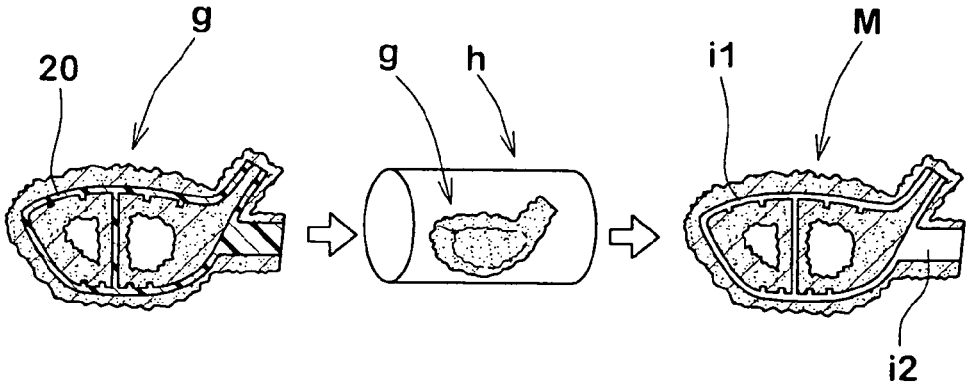
FIG. 18(*a*) shows processes of making a mold for casting.
Figure 18B:
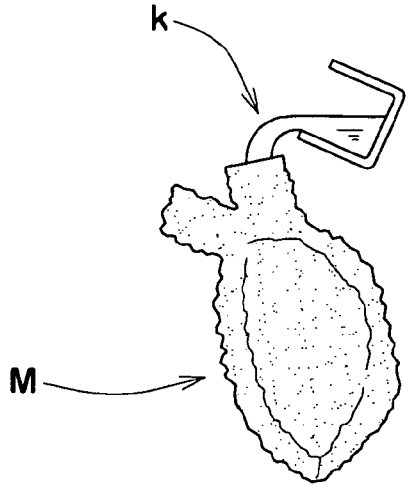
Figure 18C:
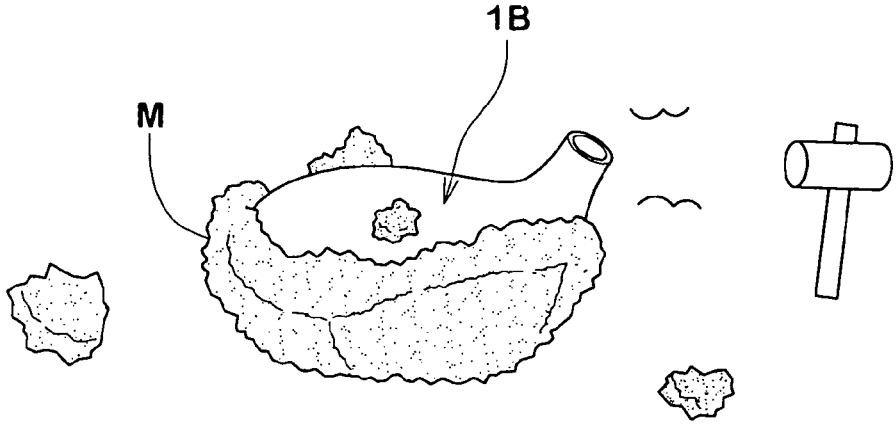
Figure 19:
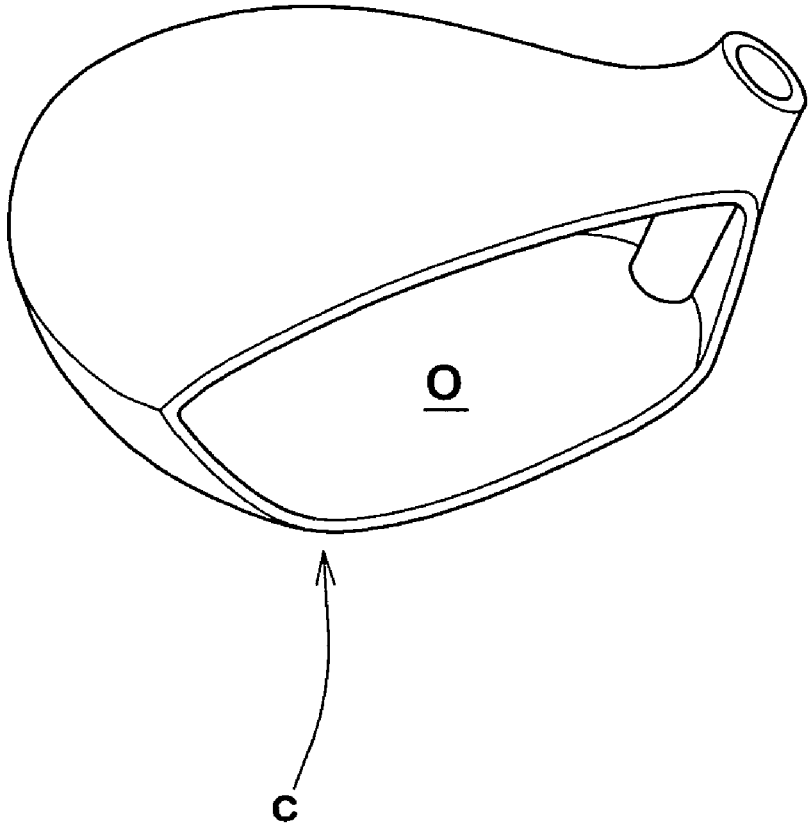
FIG. 19 is a perspective view of a head main body used in the under-mentioned comparison tests.

FIG. 18(*a*) shows processes of making the casting mold M. All the surface of the wax model 20 is coated with a fire-resistant mold material (g) which is for example a mixture of slurry and stucco cement. In order to dry up and harden the mold material (g) and in order to dewax, the mold material (g) is heated in an oven (h). As a result, the casting mold M having the mold cavity (i1) and the pouring gate (i2) is formed. As shown in FIG. 18(*b*), a molten metal (k) is poured into the casting mold M. As shown in FIG. 18(*c*), the casting mold M is broken after the metal (k) hardens to get out the head main body 1B.

The brace 26 is preferably disposed in a region Y extending 5 mm preferably 3 mm backwards from the edge of the opening (O).

In case a plurality of sound bars 10, several examples of the formation are shown in FIG. 10–FIG. 15 as explained above. These formations are also applied to the brace 26. In other words, the brace 26 doubles as the wax model 10M of the sound bars 10.

The area of the cross section of the brace 26 perpendicular to its longitudinal direction is preferably set in a range of 2 to 25 sq.mm. If the sectional area of the brace 16 is less than 2 sq.mm, it becomes difficult to prevent the deformation of the wax model 20. If the sectional area is more than 25 sq.mm, it is not preferable in view of the weight distribution or balance. It is preferable for moldability that the sectional shape of the brace 26 is a rectangle or a regular tetragon.

The above-explained structure is effectual when the head main body 1B is such that the area of the opening (O) is in the range of from 20 to 80 sq.cm especially 25 to 75 sq.cm, the height of the opening (O) or the maximum breadth of the opening (O) in the vertical direction of the head main body 1B is in the range of from 30 to 85 mm especially 40 to 70 mm, and/or the width of the opening (O) or the maximum breadth of the opening (O) in the horizontal direction of the head main body 1B is in the range of from 45 to 120 mm especially 50 to 110 mm. If the opening is small and/or the head volume is less than 200 cc, probably the wax model 20 has a necessary rigidity and it is not necessary to provide the brace 26 but a sound bar model 10. If the opening is too large and/or the head volume is more than 500 cc, it is difficult to improve the percent defective in casting the head main body. Thus, the present invention is suitably applied to a club head comprising such head main body 1B and a head volume in the range of from 250 to 450 cc.

The above-mentioned brace 26 and rib-like wall models 9M as a reinforcing structure for a wax model can be suitably applied to various types, in addition to the wood-type club head, such as iron-type, patter-type, utility-type between wood-type and iron-shaped as far as a wax model used to make the club head is hollow and has a relatively large opening. The above-explained making method can be applied to club heads for which the sound bar is not necessary. In such case, it is possible to remove the brace(s) from the head main body by means of cutting, grinding and the like after casting.

Comparison Tests

Figure 4:
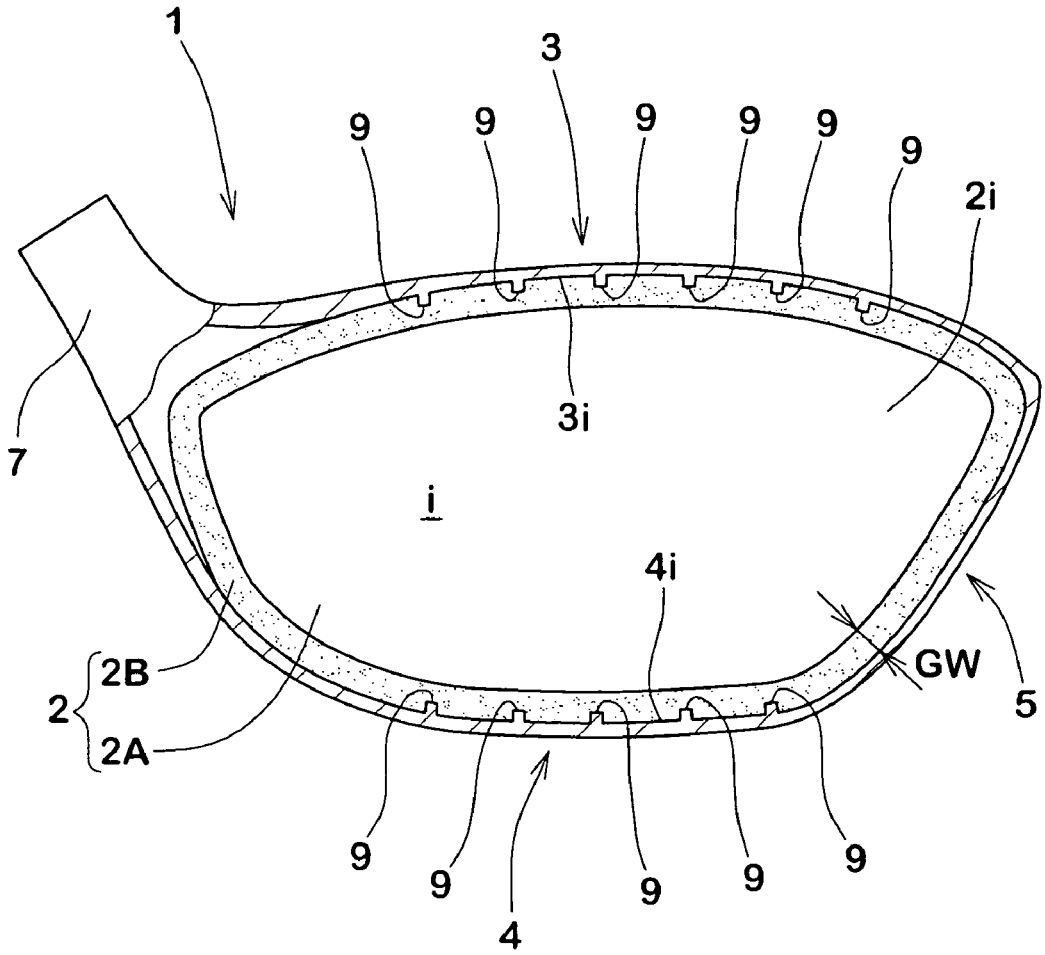
FIG. 4 is a cross sectional view of the club head showing the backside of the face portion of the club head.

Wood-type golf club heads having specifications shown in Table 1 were made and tested for reverberation of the hitting sound, hit feeling, dimensional accuracy, and percent defective. All the club heads were made of a titanium alloy Ti-6Al-4V, wherein the rib-like walls were arranged as shown in FIGS. 2–4, the thickness of the rib-like walls was 1.5 mm, the height of the rib-like walls was 1.0 mm, and the pitches of the rib-like walls were 6 mm.

Reverberation Test

The club heads were attached to identical shafts to make metal wood clubs. Each golf club was attached to a swing robot to hit a golf ball ("MAXFLI HI-BRID" Sumitomo Rubber Ind., Ltd.) with the center of the face portion under the same conditions using a precision sound level meter (Rion Co. Ltd.) with a type-A curve correction filter whose a microphone was set at a distance of 300 mm from the toe of the club head, the hitting sound was converted into electronic data and recorded. In order to find a peak frequency at which a maximum sound level occurred, a fast Fourier transformation and a time base analysis were made on the electronic data using a FFT analyzer (CF-6400, ONO SOKKI Co. Ltd.) under the following conditions:

Analyzing frequency range: 0 to 16 kHz

Number of sample data: 2048

Sampling time: 0 to 48 ms from the time of hitting the golf ball

Time window: Hanning window

The peak frequency and the maximum sound level were obtained by a PWR method.

In FIG. 1, as the degree of the reverberation, there is shown a quotient of the sound pressure level at time point after 0.04 seconds from the time of hitting, divided by the peak sound pressure level at the time of hitting, each level obtained with respect to the following frequency band, using a wavelet analysis software (DS-9100, ONO SOKKI Co., Ltd.) under the following conditions:

Analysis time frame length: 2048

Gabor function: equivalent to 1/12 octave

Analysis range: six octave

The frequency band was determined from the frequency range of from 4000 to 7000 Hz as a band at which the sound pressure level at time point after 0.04 seconds from the hitting becomes maximum. Incidentally, the microphone and FFT analyzer were calibrated at 250 Hz and 124 dB. As the value of the quotient is larger, the reverberation is larger in the sound pressure level and goes longer.

Hitting Sound Feeling Test

Ten golfers whose handicaps ranged from 5 to 20 evaluated the hitting sound of each club into five ranks, wherein the higher the rank number, the better the hitting sound. In Table 1, the mean values of the ten golfers are shown.

Dimensional Accuracy Test

To obtain a difference from the design height, the actual height of the head main body was measured, using a slide gauge, as a distance between a fixed point on the shell crown portion and a fixed point on the shell sole portion.

Casting Percent Defective Test

The percentage of defective products caused during casting was obtained. Here, the defective product is defined as having a difference of 0.5 mm or more between the actual height and design height. The obtained percent defective is indicated in Table 1 using an index based on Ref.3 being 100, and the smaller index number shows less defective.

TABLE 1

| Club head | Ex. 1 | Ex. 2 | Ex. 3 | Ex. 4 | Ex. 5 | Ref. 3 | Ref. 2 | Ref. 1 |
|---|---|---|---|---|---|---|---|---|
| Head volume (cc) | | | | 350 | | | | |
| Thickness | | | | | | | | |
| Crown portion (mm) | | | | 0.9 | | | | |
| Sole portion (mm) | | | | 1.1 | | | | |
| Side portion (mm) | | | | 0.9 | | | | |
| Opening | | | | | | | | |
| Height (mm) | 50 | 50 | 50 | 50 | 50 | 70 | 70 | 50 |
| Width (mm) | 100 | 100 | 100 | 100 | 100 | 80 | 110 | 100 |
| Area S (sq. cm) | 39.5 | 39.5 | 39.5 | 39.5 | 39.5 | 45 | 75 | 39.5 |
| Area S/Club face area | 1.0 | 1.0 | 1.0 | 1.0 | 0.87 | 1.0 | 1.0 | 1.0 |
| Sound bar | | | | | | none | none | none |
| Arrangement | I type | II type | N type | W type | II type | — | — | — |
| Sectional shape | rectangle | rectangle | rectangle | square | rectangle | — | — | — |
| Sectional area (sq. mm) | 15 | 15 × 2 | 15 × 3 | 9 × 4 | 15 × 2 | — | — | — |
| Position from Opening edge (mm) | 0 | 0 | 3 | 0 | 0 | — | — | — |
| Method of making Wax model | FIG. 17 | FIG. 17 | FIG. 17 | FIG. 16 | FIG. 17 | — | — | — |

TABLE 1-continued

| Test results | | | | | | | | | |
|---|---|---|---|---|---|---|---|---|---|
| Reverberation | 0.85 | 0.84 | | 0.84 | 0.84 | 0.83 | 0.62 | 0.68 | 0.83 |
| Feeling | 4.3 | 4.3 | | 4.2 | 4.3 | 4.1 | 2.1 | 2.5 | 4.1 |
| Dimensional difference (mm) | −0.52 | −0.30 | | −0.04 | −0.06 | −0.05 | −12.35 | −25.84 | −5.31 |
| Percent defective (index) | 16 | 11 | | 6 | 8 | 5 | 100 | 100 | 82 |
| **Club head** | **Ex. 6** | **Ref. 4** | **Ref. 5** | **Ex. 7** | **Ex. 8** | **Ref. 6** | **Ex. 9** | **Ex. 10** | **Ref. 7** |
| Head volume (cc) | | 350 | | | 305 | | | 450 | |
| Thickness | | | | | | | | | |
| Crown portion (mm) | | 1.2 | | | 0.9 | | | 0.7 | |
| Sole portion (mm) | | 1.3 | | | 0.9 | | | 1.0 | |
| Side portion (mm) | | 0.9 | | | 0.9 | | | 0.8 | |
| Opening | | | | | | | | | |
| Height (mm) | 50 | 50 | 70 | 45 | 45 | 45 | 70 | 70 | 70 |
| Width (mm) | 100 | 100 | 110 | 95 | 95 | 95 | 110 | 80 | 110 |
| Area S (sq. cm) | 39.5 | 39.5 | 75 | 35 | 35 | 35 | 75 | 45 | 75 |
| Area S/Club face area | 1.0 | 1.0 | 1.0 | 1.0 | 1.0 | 1.0 | 1.0 | 0.65 | 1.0 |
| Sound bar | | none | none | | | none | | | none |
| Arrangement | I type | — | — | I type | reverse N type | — | W type | II type | — |
| Sectional shape | rectangle | — | — | rectangle | rectangle | — | rectangle | rectangle | — |
| Sectional area (sq. mm) | 30 | — | — | 15 | 15 × 3 | — | 15 × 4 | 15 × 2 | — |
| Position from Opening edge (mm) | 0 | — | — | 0 | 0 | — | 0 | 0 | — |
| Method of making Wax model | FIG. 17 | — | — | FIG. 16 | FIG. 16 | — | FIG. 17 | FIG. 17 | — |
| Test results | | | | | | | | | |
| Reverberation | 0.86 | 0.69 | 0.68 | 0.81 | 0.81 | 0.81 | 0.84 | 0.83 | 0.69 |
| Feeling | 4.4 | 2.7 | 2.5 | 4.0 | 4.1 | 4.0 | 4.2 | 4.1 | 2.6 |
| Dimensional difference (mm) | −0.05 | −3.21 | −5.51 | −0.69 | −0.40 | −15.1 | −0.45 | −0.28 | −22.31 |
| Percent defective (index) | 12 | 100 | 100 | 40 | 35 | 100 | 32 | 41 | 100 |

The invention claimed is:

1. A method of making a golf club head comprising a hollow main body provided on the front with an opening and a face plate disposed on the front of the main body, said method comprising making a hollow wax model of said hollow main body, wherein the wax model has an opening corresponding to said opening and the wax model comprises a brace extending across the opening to prevent deformation of the wax model, and making a casting mold using the wax model, casting a metal material into the head main body using the casting mold, and cutting said brace to form a sound bar having a free end and an end fixed to the head main body.

2. A method of making a golf club head comprising a hollow main body provided on the front with an opening and a face plate disposed on the front of the main body, said method comprising making a hollow wax model of said hollow main body, wherein the wax model has an opening corresponding to said opening and the wax model comprises a brace extending across the opening to prevent deformation of the wax model, and making a casting mold using the wax model, casting a metal material into the head main body using the casting mold, and removing said brace from the cast head main body.

3. The method according to claim 1 or 2 which further comprises making a face plate from a metal material by die-cutting and press working, and welding the face plate to the cast head main body.

4. The method according to claim 1 or 2 which further comprises making a face plate by forging a metal material, and welding the face plate to the cast head main body.

5. The method according to claim 1 or 2, wherein said wax model further comprises protruding walls disposed on the inner surface of the wax model and extend backwards from the opening.

6. The method according to claim 5, which further comprises making a face plate from a metal material by die-cutting and press working, and welding the face plate to the cast head main body.

7. The method according to claim 5, which further comprises making a face plate by forging a metal material, and welding the face plate to the cast head main body.

* * * * *